US005970940A

United States Patent [19]

Penton

[11] Patent Number: 5,970,940

[45] Date of Patent: Oct. 26, 1999

[54] MECHANICAL STARTER MOTOR

[75] Inventor: Jonathan Michael Penton, Canterbury, United Kingdom

[73] Assignee: Pentham Limited, United Kingdom

[21] Appl. No.: 08/894,531

[22] PCT Filed: Feb. 16, 1996

[86] PCT No.: PCT/GB96/00354

§ 371 Date: Aug. 21, 1997

§ 102(e) Date: Aug. 21, 1997

[87] PCT Pub. No.: WO96/26363

PCT Pub. Date: Aug. 29, 1996

[30] Foreign Application Priority Data

Feb. 22, 1995 [GB] United Kingdom ..... 9503488

[51] Int. Cl.[6] ..... F02N 5/02

[52] U.S. Cl. ..... 123/185.14; 185/41 A

[58] Field of Search ..... 123/185.14; 185/39, 185/41 A, 41 WW

[56] References Cited

U.S. PATENT DOCUMENTS

| | | | |
|---|---|---|---|
| 1,511,082 | 10/1924 | Johnston | 185/41 R |
| 2,875,851 | 3/1959 | Vakos | 123/185.14 |
| 3,127,883 | 4/1964 | Sparrow | 123/185.14 |
| 3,692,010 | 9/1972 | Dooley et al. | 123/185.14 |
| 3,853,109 | 12/1974 | Dooley | 123/179 S |
| 4,104,927 | 8/1978 | Jensen et al. | 123/179 S |
| 4,230,084 | 10/1980 | Gotoh et al. | 123/179 S |
| 5,186,134 | 2/1993 | Morishima et al. | 123/179.5 |
| 5,537,966 | 7/1996 | Ohnishi | 123/184.14 |

FOREIGN PATENT DOCUMENTS

| | | |
|---|---|---|
| 623743 | 11/1994 | European Pat. Off. . |
| 905782 | 9/1962 | United Kingdom . |
| 974737 | 11/1964 | United Kingdom . |
| 2273961 | 7/1994 | United Kingdom . |

*Primary Examiner*—Tony M. Argenbright
*Assistant Examiner*—Arnold Castro
*Attorney, Agent, or Firm*—Finnegan, Henderson, Farabow, Garrett & Dunner, L.L.P.

[57] ABSTRACT

Starter motor for internal combustion engines which operates mechanically using stored spring energy as the power source whereby the spring comprises a spiral power spring.

23 Claims, 5 Drawing Sheets

MECHANICAL STARTER MOTOR

This invention relates to starter motors for internal combustion engines and has particular reference to starter motors which operate mechanically using stored strain energy as the power source.

BACKGROUND OF THE INVENTION

Modern starter devices are driven by electric motors which must be powerful enough to crank an engine. The energy source is usually a battery which will typically need to provide a current in excess of 200 amps at 12 volts to provide starting of an engine. In particular the starting of heavy diesel engines can require a power supply in excess of this.

In extreme conditions such as severe heat or cold or humidity, the battery and its associated electrical system can quickly become impaired. This is particularly true where servicing and maintenance are sub-standard or absent. Furthermore, in certain environments, electrically powered starters represent a fire hazard and, for example, the use of such starters in mines, is not permissible.

Mechanical starters provide a more reliable source of starting energy for internal combustion engines than electrically powered starting devices.

Mechanical starting devices hitherto employed typically comprise spring means for storing energy, means for applying energy to said spring means to store energy therein and drive means for converting said stored energy when released to provide a starting impulse for said engine.

In devices of the kind described, the spring means may comprise a bank of disc springs; the springs are strained by repeated manual rotation of a crank handle which rotates a worm on a shaft passing through the centre of said springs which worm is threaded through an end plate so that rotations of the worm moves the end plate to compress the discs. Once sufficient energy has been stored, the energy is manually released by disengaging a ratchet pawl. The spring reacts in an axial direction and the mechanism converts that axial movement into rotational energy. The rotational energy is directed to an output shaft which may include a pinion adapted to mesh with a ring gear carried on an engine flywheel.

Such known mechanical starters use a detachable crank handle to "wind up" the spring mechanism in order to store energy therein. These handles need to be of considerable dimension in order to apply the necessary energy and to provide the necessary mechanical advantage for the operative. This in turn limits the positioning and orientation of the starter to a position which allows free access of the crank handle and easy access generally to that part of the engine.

Compression ignition engines such as diesel engines are particularly amenable to starting by such mechanical devices because they do not require in the normal course of events the associated electrical system to maintain them in operation. Furthermore, the amount of rotation available to a mechanical starter is limited by the travel of the disc springs in the time period before the stored energy is exhausted. In starters currently available, the spring travel is small and short lived. They are, thus, most successful for use with multiple cylinder diesel engines where a combustion event is likely to occur over the arc of rotation of the crank shaft induced by the starting device.

As stated above the spring energy of the disc springs is released as an axial motion which has to be converted to rotational motion to be useful in the starting of an engine. The energy losses involved in the conversion processes are significant and furthermore such a motor must be heavily engineered to be able to withstand extremely high axial forces exerted by the springs. This adds to both cost and weight, to such an extent, as to make their use at a premium.

There is, therefore, a need for a mechanical starting device of improved efficiency and versatility which enables the starter to be used to start a wide range of engines. There is also a need for a mechanical starting device having reduced weight and being of cheaper construction. There is a further requirement for a starting device which is convenient to operate and does not require, of necessity, a crank handle of large throw.

U.S. Pat. No. 3,127,883 seeks to provide a solution to this problem and the primary aim of the invention described therein is to provide an improved spring starter motor that is efficient and safe. More specifically, it is an object of the invention to provide an improved starter motor which cannot be accidentally tripped when wound and which has no projecting parts which are driven during the starting operation.

SUMMARY OF THE INVENTION

According to one aspect of the present invention there is provided a mechanical starting device comprising a spiral power spring for storing energy, winding means for applying energy to said spring to store energy therein and drive means for converting said stored energy when released to provide a starting impulse for an engine, characterized in that said spring and the winding means act in conjunction with control means (94,95,100,107) adapted to release the stored energy of the spring to a drive shaft automatically after a given amount of energy has been stored in the spring.

The present invention further provides in the further aspects a mechanical starting device which is characterised by one or more of the following features taken separately or in any combination:

(i) The spring means comprises a spiral power spring; as used in this specification the term "spiral power spring" will mean a clock type spring comprised of a material forming a continuous spiral of flat ribbon material in which potential is stored by tightening the spiral coils of the spring.

(ii) The spring means may comprise a bank of ribbon springs operating in parallel or a single spring.

(iii) The spiral ribbon spring may be altered in its dimension both width, length and thickness in order to control the output power and number of turns of the starting device.

(iv) The spiral spring means can be strained by rotation of one end relative to the other, the rotation being in the same direction as the spring spiral.

(v) One extremity of the spring spiral may be secured to an output shaft while the other end is rotated to tighten the spiral and means may be provided to release the output shaft whereby the potential energy stored in the spring is released directly to rotational energy.

(vi) The storage of potential energy may be achieved by rotation of the inner edge while the outer extremity of the spring is held.

(vii) The storage of potential energy may be achieved by rotating the outer edge relative to the inner extremity, thus resulting in a mechanical advantage which eases the winding process.

(viii) The spiral power spring may be in the form of a coil which is connected at its inner edge to the drive shaft and at its outer extremity to a rotating housing. The rotating housing is preferably coaxial with said drive shaft and adapted to be rotatable relative thereto.

(ix) Winding means may be provided which is adapted to rotate the spring housing member relative to the inside edge of the spring to store potential energy therein.

(x) The winding means may be a rope pull winder.

(xi) Gear means may be provided between the winding means and the rotating spring housing for the purpose of providing a mechanical advantage therebetween. The gear means may be an epicyclic gear means.

(xii) The spiral power spring and the winding means therefore, may act in conjunction with a control and release means which includes means to release the potential energy of the spring to the drive shaft automatically after a given amount of energy has been stored in the spring.

(xiii) The control and release means may include a latch to prevent rotation of the drive shaft during winding and release means may be provided to unlatch the drive shaft once winding is complete.

(xiv) An epicyclic gear train may be provided between the winding means and the spring means and may comprise at least three planet gears which are substantially uniformally circumferentially spaced about the axis of the drive shaft thereby providing a solid structure to balance the stresses during winding.

(xv) The winding means may include a substantially disc-shaped winding member adapted to be wound by means of a pull rope. The winding means may include a recoil spring and a ratchet whereby on pulling the winding rope the ratchet is engaged to drive the gear train and effect winding of the spring and on release of the tension in the winding rope the recoil spring serves to rewind the rope ready for the next pull. The use of a pull winder in these circumstances permits much more flexible use and operation. For example, the starting device in accordance with the present invention may be incorporated in a much more restrictive space and the starting rope may be led to a more convenient position for operation. In one aspect of this feature of the invention, the rope may be fed through a tube or conduit to a much more convenient position on a dash board or instrument panel significantly away from the starter device per se as attached in its operative position on the engine. A further advantage is that there is less potential danger to using a rope pull of the kind described compared with a crank handle. A failure in the crank handle mechanism may result in unexpected crank on rotation with corresponding arm injury to an operative.

(xvi) The winding means may further include ratchet means to provide for integer increases in the potential energy of the spring during winding. In particular aspect of the invention the ratchet for the recoil device and the ratchet for the spring housing may be substantially concentric and provided in a single annulus.

(xvii) The control and release means may comprise a further pawl and ratchet active between the drive shaft and a housing for the device.

(xviii) The pawl may be arranged to coact with a cam surface, which is caused to rotate in response to the winding operation, the arrangement being such that rotation of the cam brings the extremity of the cam edge into tripping relationship with the pawl only when sufficient potential energy has been applied to the spiral power spring.

(xix) The cam may be driven by the spring housing via an epicyclic gear arrangement.

(xx) The ratchet wheel of the release and control means may be provided with contoured ratchet recesses in the outer surface thereof and each recess is adapted to cooperate with a corresponding contoured nose at the end of the pawl, the arrangement being such that the minimum of friction is required to disengage the pawl from the corresponding recess in the ratchet thereby to release the drive shaft.

(xxi) The pawl may be located on a fixed part of the housing and the ratchet may be associated with the drive shaft. In a particular embodiment of the present invention, the ratchet may form part of the drive pinion which engages the starter ring of the engine to be started.

(xxii) The starter pinion and its associated ratchet may be provided with a central bore with multi-start threads or teeth cut internally thereof.

(xxiii) The pinion may be adapted to be mounted on corresponding multi-part teeth carried at a forward end of the shaft adapted to be deposed towards the flywheel of the engine to be started. The pinion may be biased to a position out of engagement with the said starter ring as, for example, by use of a compression spring, the arrangement being such that in order to bring the pinion into engagement with the starter ring, relative rotation of the pinion relative to the drive shaft will cause the pinion to advance along the multi-start threads or teeth to enter into engagement with the starter ring per se.

(xxiv) The pawl may be elongate in the direction of travel of the pinion to remain in engagement with its corresponding recess on the ratchet. The assembly should be such that on commencement of winding, the pinion will be prevented from rotation by means of the pawl, but the shaft will be free to rotate and the interaction of the multi-start teeth or threads will serve to drive the pinion into engagement with the starter ring. At the extremity of its travel, further rotation of the drive shaft will be prevented.

(xxv) In a particular aspect of the invention the essential components other than the spring are manufactured of plastics materials.

(xxvi) The epicyclic gear trains are generally formed from glass filled nylon while the drive shaft, drive pinion and winding gear may be produced of a nylon derivative commercially available under the trade name "VERTON". The use of such material has the advantage that the device is light in weight, requires no bearings between the moving parts and is cheap to manufacture. An additional advantage is that the extensive use of the plastics components throughout the device means that the device is very well adapted to working in inclement conditions such as highly humid conditions or a marine environment.

Following is a description by way of example only with reference to the accompanying drawings of methods of carrying the invention into effect.

DETAILED DESCRIPTION OF THE INVENTION

Figure 4:
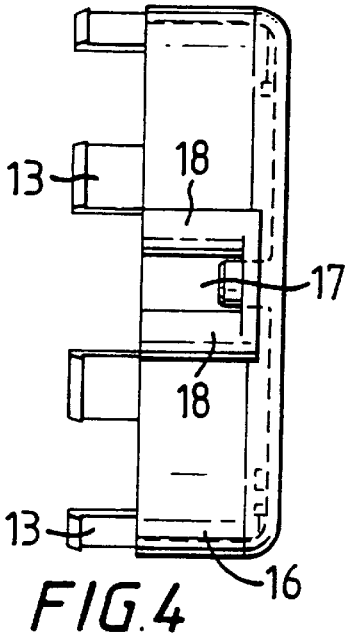
FIG. 4 is a side view of FIG. 3.
Figure 5:
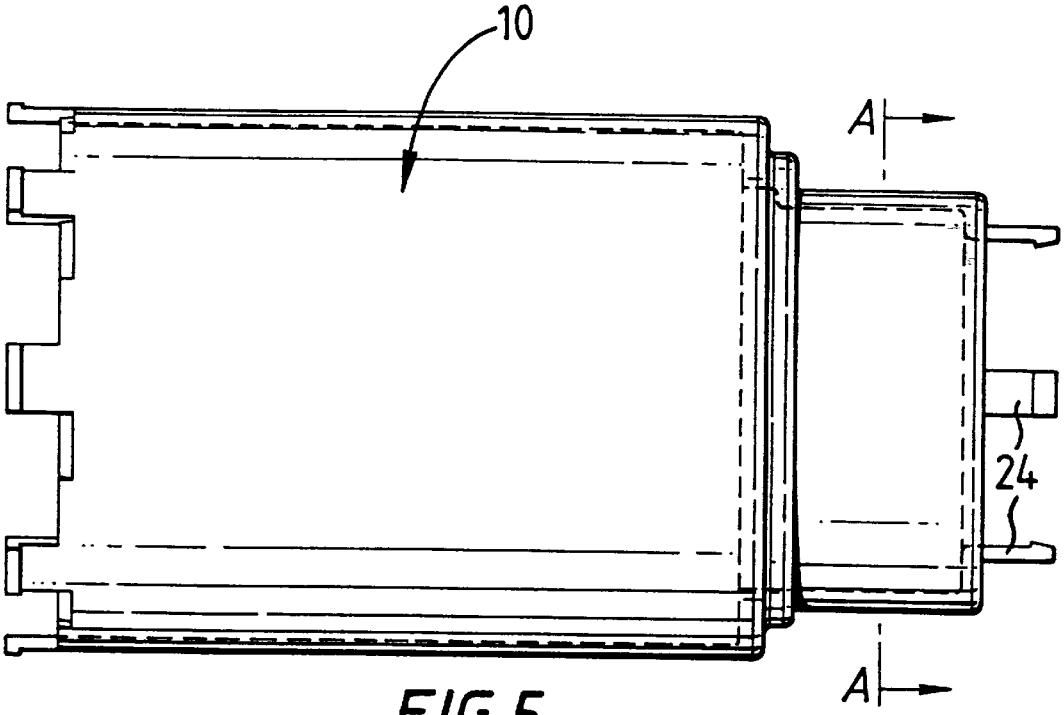
FIG. 5 is a side view of the spring housing or carcase of the device of FIG. 1.
Figure 6:
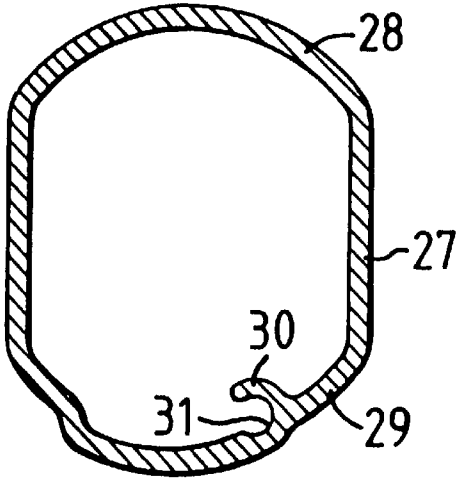
FIG. 6 is a section on the line A—A of FIG. 5.
Figure 7:
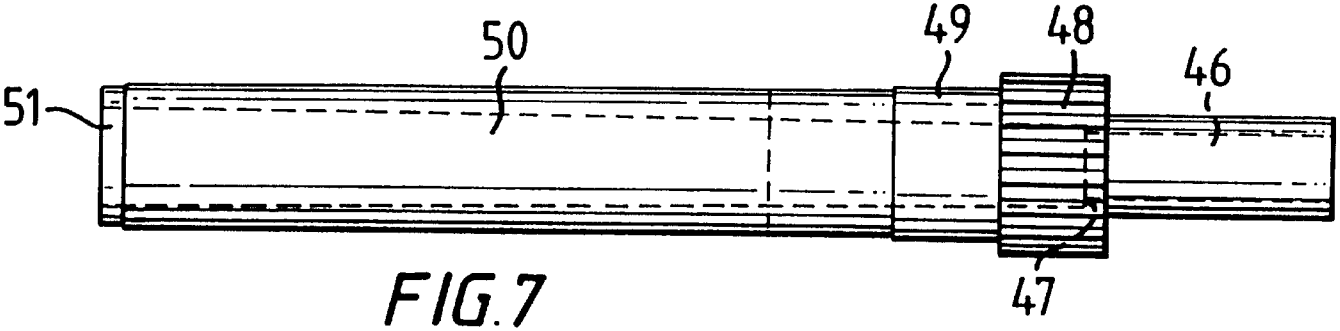
FIG. 7 is a detail of the drive shaft of the device of FIG. 1.
Figure 10:
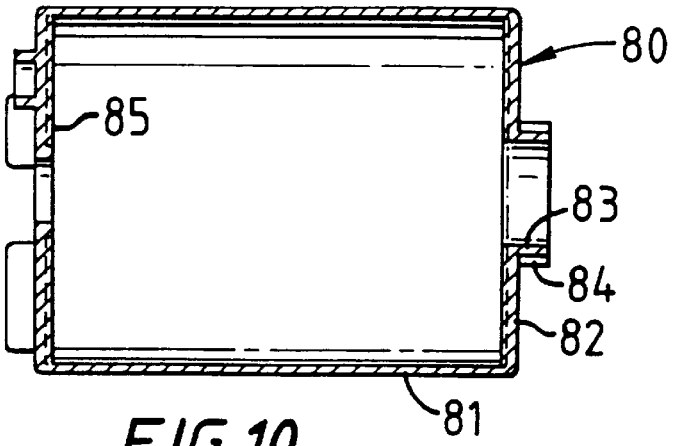
FIG. 10 is a section through the spring drum of FIG. 1.

A starter device in accordance with the present invention comprises an outer housing 10 of generally cylindrical configuration. The housing 10 has at its rearward end an end cap 11 which has an inwardly directed central spigot 12. End cap 11 is provided with a plurality of forwardly extending tongues 13 (see FIG. 4) adapted to engage with corresponding portions at the rearward end of cylindrical housing 10 for the purpose of securing the end cap thereto. The end wall 14 of end cap 11 is generally circular and is provided with an inwardly directed annular rib 15. The external cylindrical wall 16 of end cap 11 is provided with an opening 17 which is provided with a pair of axially extending rounded lips 18 which together define a rope guide opening 19. Cylindrical housing 10 is provided at its forward end with an inwardly directed annular wall 20 provided with an intermediate step portion 21 which carries at its inner end a forward extension 22. Forward extension 22 terminates in an inwardly directed flange 23 which carries a plurality of circumferentially spaced, forwardly extending engaging elements 24, each having at its forward extremity an inwardly directed barb 25. The intermediate step portion 21 carries on its internal surface a plurality of teeth constituting a ring gear 26. The forward extension 22 is Defined by a pair of spaced parallel walls and a pair of generally arcuate walls 28 and 29, (see FIG. 6) the lower wall 29 has an inwardly projecting arcuate hook 30 extending generally longitudinally of the forward extension and serving to define a generally cylindrical recess 31' which is open longitudinally along its length to receive a pawl element as hereinafter described.

The forward extension 22 of the cylindrical housing 20 of cylindrical housing 10 is adapted to carry a pinion housing 35 comprising a generally cylindrical portion 36 adapted to overlay and be a sliding fit on forward extension 22 of cylindrical housing 10, said portion 36 having a forward annular wall 37 extending generally inwardly therefrom and being provided with a plurality of openings 38 the inner wall of each of which has a step or detent 39, the arrangement being such that when the pinion housing 35 is entered over the cylindrical portion 22 of housing 10, the barb portion 25 of each engaging element 24 latches into detent 39 to retain pinion housing 35 in place. The forward wall 37 is provided with a pinion casing 40 which is cut away at its lower end and terminates at its forward extremity in a journal 41. The casing 40 is reinforced by circumferentially spaced flanges 42 (see FIG. 2).

The journal 41 carries a stub axle 43 extending rearwardly of the journal, said stub axle terminating in a barbed rib 44. A drive shaft indicated generally at 45 is provided with a generally hollow central bore 46 which bore is expanded to define an annular shoulder 47 which is adapted to engage with barbed rib 44 of stub axle 43 for retaining the drive shaft on said axle; said shaft being arranged for rotation relative thereto.

The drive shaft 45 is provided towards its forward end with a plurality of spiral splines or teeth and immediately rearwardly thereof is provided with a further reduced cylindrical portion 48, 49 constituting a bearing surface.

The rearward part of the shaft is provided in its external surface with a plurality of longitudinal grooves or splines each approximately 0.5 mm deep extending towards the rearward end 51, which latter is slightly reduced in diameter and is provided with a smooth cylindrical surface constituting a bearing surface.

Figure 9:
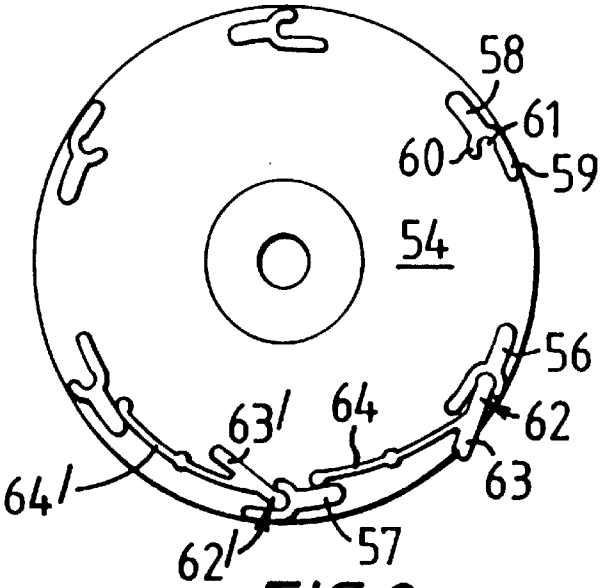
FIG. 9 is an end view of FIG. 8.
Figure 8:
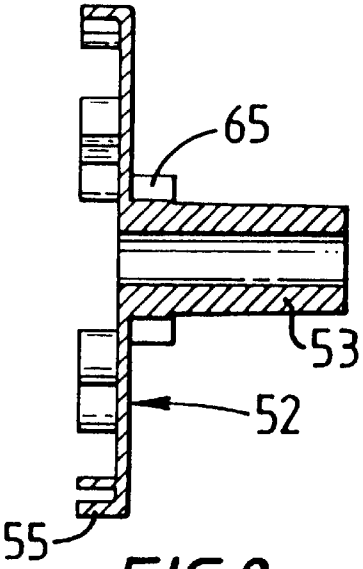
FIG. 8 is a section of the winding ratchet of the device of FIG. 1.

The central bore 46 of drive shaft 45 is adapted to accommodate at its rearward end a winding ratchet 52 (see FIG. 8) comprises a generally tubular portion 53 adapted to enter into the central bore 46 of drive shaft 45, and an annular plate 54 terminating in a rearwardly directed circumferential flange 55. The rearward face of annular plate 54 carries towards the circumference thereof 6 circumferentially spaced ratchet holders 56 and 57, alternate ones of which are handed as shown in FIG. 9. Ratchet holder 56 is a "outer" ratchet holder and ratchet holder 57 is a "inner holder". Each ratchet holder comprises an arm 58 with a long element 59 and a short element 60. The point of bifurcation of arm 58 to long element 59 and short element 60 defines a part cylindrical socket which latter is adapted to receive a corresponding part of a "dog bone" ratchet element (not shown).

The dog bone ratchet elements are also handed and extend between adjacent holders. The outer ratchet holder 56 contains a dog bone ratchet element 62 having a pawl portion 63 and an arcuately extending arm 64, the arrangement being such that the pawl portion 63 extends outwardly away from the centre of the annular plate 54.

Inner ratchet holder 57 holds inner dog bone ratchet element 62' having a pawl element 63' and arcuate arm 64', the arrangement being such in this case that the pawl element is directed inwardly towards the axis of plate 54. The complete assembly of dog bone ratchet elements 62, 62' in each of the holders 57 and 58 respectively serve to define an annular ratchet assembly operative both inwardly and outwardly of the assembly.

The rearward end of tubular portion 53 carries for relative rotation thereto a rope element 69. This comprises a generally circular winder drum body 70 carrying on its forward face a ratchet which is adapted to engage with the inner pawl 63' with corresponding dog bone ratchet elements 62' carried by holders 57 on annular plate 54. Element 69 has a forwardly extending spigot 72 adapted to enter tubular portion 53 of winding ratchet 52. The axis of body 70 is provided with a blind bore 73 adapted to receive spigot 12, which latter provides the rearward support for the drive shaft, winding ratchet and winding drum assembly. The drum is provided with a peripheral rope receiving groove 74 whereby the end of the rope can be entered and secured with a cavity 75, which is then wound within groove 74 and exits from the drum by means of rope guide opening 19 in end cap 11. A recoiled spring 76 is provided between end cap 11 and winder drum 69 to effect rewinding of the rope on each stroke of the pull.

Shaft 45 carries, journalled for rotation with respect thereto, a spring housing indicated generally at 80. The spring housing has a generally cylindrical outer wall 81, a front end face 82 terminating at its inner extremity in a forwardly extending sleeve 83 carrying on its outer cylindrical surface, a plurality of gear teeth 84 which forms a 36 toothed, 24 dp spur gear. The rearward end face 85 is provided with a central bore adapted to be accommodated about drive shaft 45 and is provided, intermediate the inner and outer extremities of rearward face 85, with three hub 85' spaced circumferentially about the axis of the housing. Each hub 85' is adapted to carry an 18 tooth 12 dp spur gear freely rotatable thereon, each of said gears engaging with the sun gear 65 carried by the winding ratchet. Each of spur gears 87 also engages with an annular ring gear 88 secured to the end cap 14 and housing 10. Ring gear 88 is provided in a rearward part with a ratchet extension 89 which is provided on its cylindrical inner surface with a plurality of ratchet steps adapted to engage with the outer dog bone ratchet pawls 62 to allow rotation of the spring drum 80 relative to housing 10 in one direction only.

The drum 80 carries a single, spirally wound, leaf power spring generally in the form of a clock spring, the inner end of which is fixedly secured to drive shaft 45 and the outer extremity of which is secured to casing 80. The inner end of the spring is secured to the shaft as by gluing whereby the splines on the shaft form an interengagement between the steel of the spring and the shaft. The drum housing 80 is formed of a plastics material which is roughened on the inside and a substantial area is glued to the adjacent surface of the spring, the arrangement is such that with the shaft 45 locked against rotation, pulling on the rope end causes winder drum 69 to rotate to cause interaction between the inner ratchets to drive winding ratchet about its axis relative to the shaft while the outer ratchets ride over the outer pawls. The rotation of the winding ratchet 52 produces rotation of spring drum 80 via the sun gear 65, spur gears 87 and ring gear 88 at a much reduced rate to the rate of rotation of winder drum 69. When the rope has been withdrawn to the maximum of its travel, recoil spring 76 will have been tensioned so that relaxation of the rope will allow recoil ring 76 to reverse the direction of rotation of the winder drum relative to the winding ratchet 52 which winding ratchet 52 is locked against reverse rotation by means of the interaction between pawls 63 and the ratchet steps on ratchet extension 89 thus allowing the additional tension applied in the main spring 90 to be stored as potential energy. Continued pulling on the rope of the winder drum and subsequent relaxation will produce incremental increases in the potential energy stored in the spring 90 until the ring reaches the optimum level of tension.

Figure 11:
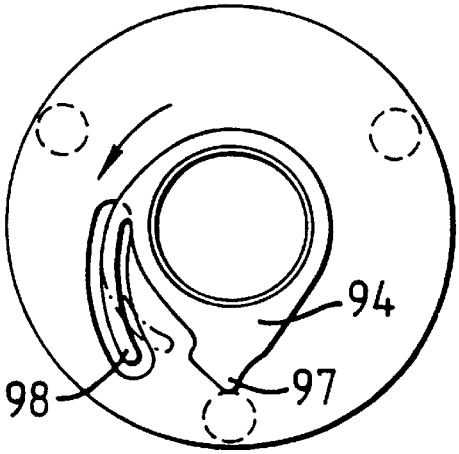
FIG. 11 is a detail of the pawl cam of the device of FIG. 1.
Figure 12:
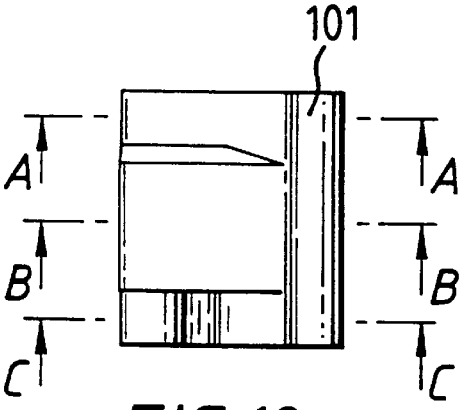
FIGS. 12, 12A, 12B and 12C are details of the pawl.
Figure 12A:
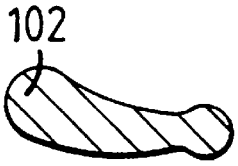
Figure 12B:
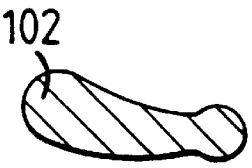
Figure 12C:
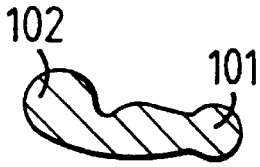

The shaft 45 carries forwardly of the front face 82 of the spring drum 80, a cam member 93 journalled for rotation about shaft 45. Cam member 93 comprises a substantially planar disc with a forwardly extending cam element 94. The rearward face of cam member 93 is provided with three equally spaced gear carrying studs 95 each of which carries a planet gear 96, the teeth of which are adapted to mesh between the gear teeth 84 on cylindrical extension 83 of spring drum 80 and the ring gear 26 provided internally of housing 10, the arrangement being such that rotation of drum 80 serves to drive cam 94 about shaft 45. Cam 94 is configured as shown generally in FIG. 11, the cam surface being generally eccentric and being substantially arcuate over approximately half of its surface then extending into a cam arm 98. Cam pawl 100 (see FIG. 12) is generally longitudinal and is provided with a pivot portion 101 extending longitudinally of the cam and adapted to be accommodated within the hook 30 (see FIG. 6). The pawl nose is generally rounded in accordance with the sections 12*a*, 12*b* and 12*c* of FIG. 12 at various intermediate stages along the longitudinal length of the pawl.

Forwardly of the cam member, shaft 45 carries pinion 104 comprising of forward tooth part 105 adapted to engage with the teeth of the starter ring of an engine to be started and intermediate portion 106 and rearward ratchet 107 which is adapted to engage with pawl 100. Pinion 104 is spring loaded rearwardly with respect to pinion housing 35 by means of compression spring 108. Intermediate portion 106 is provided on its interior surface 109 with a plurality of spiral splines or teeth 110 adapted to engage with spiral splines or teeth 48 on the drive shaft, the arrangement being such that relative rotation between the shaft 45 and pinion 104 will result in the pinion moving axially of shaft 45 either forwardly or rearwardly to the limit of its travel.

Figure 1:
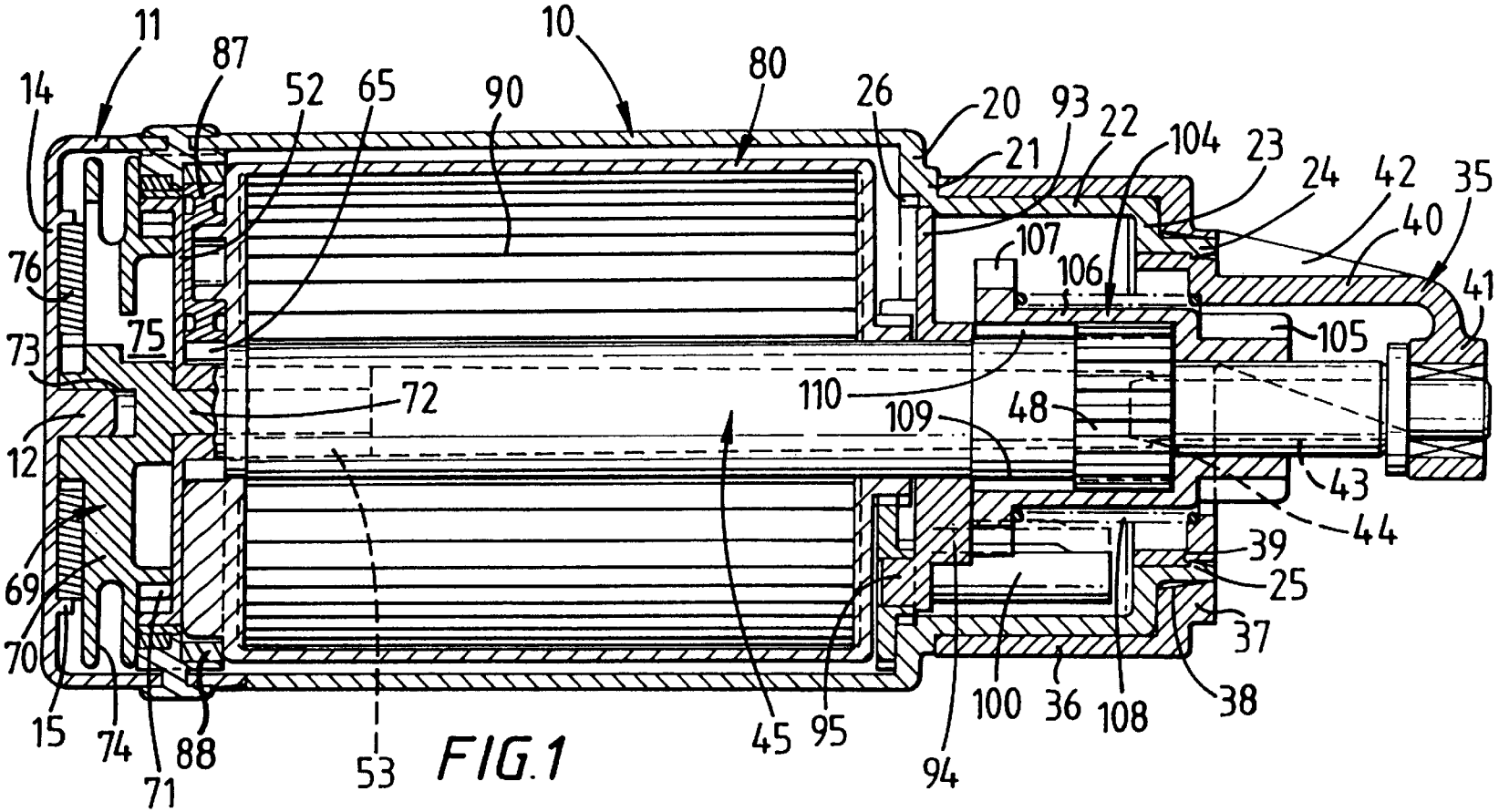
FIG. 1 is a longitudinal section of a starting device in accordance with the present invention.
Figure 2:
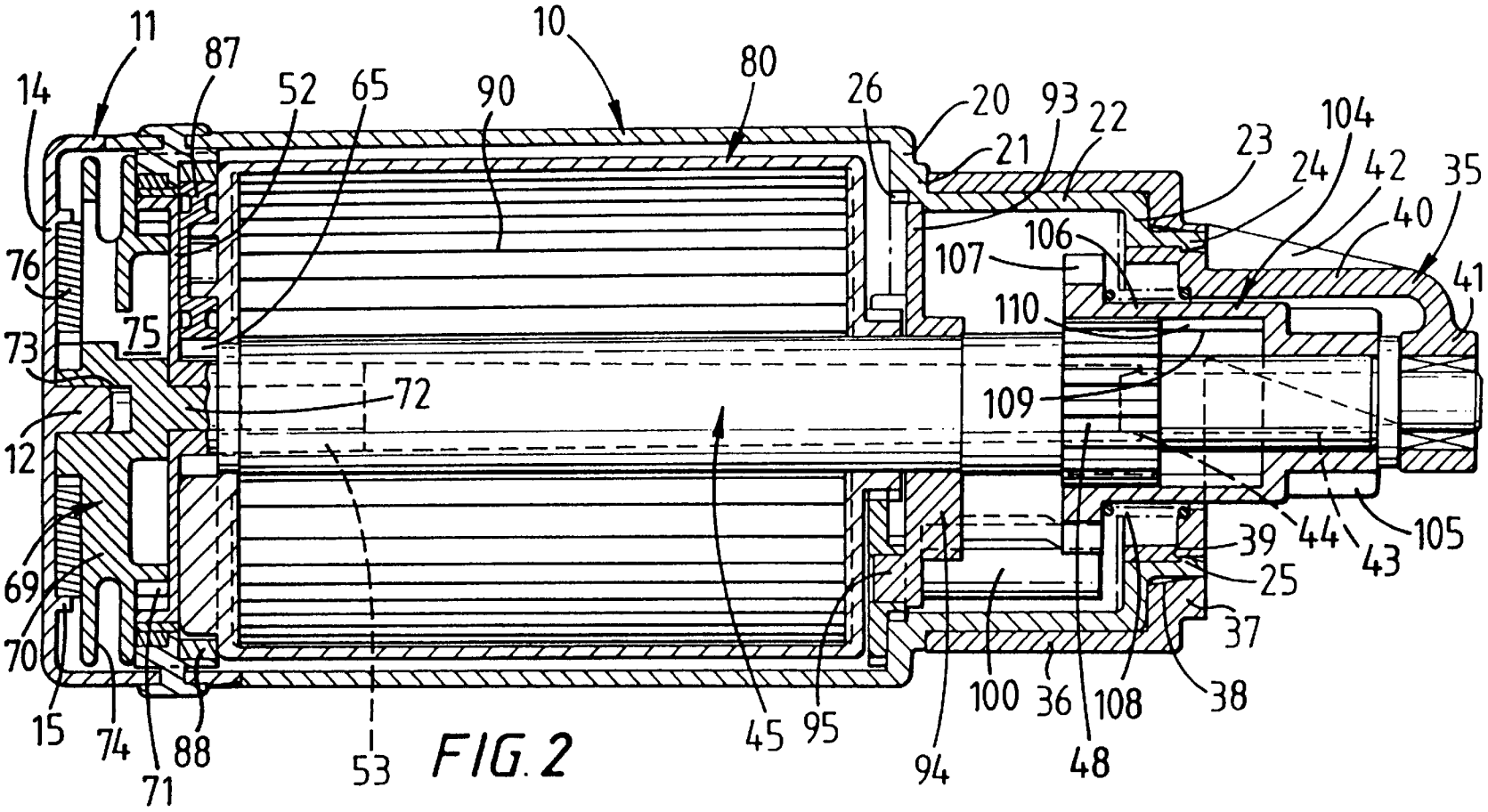
FIG. 2 is an identical view to FIG. 1 showing the starter pinion in the engaged position.
Figure 3:
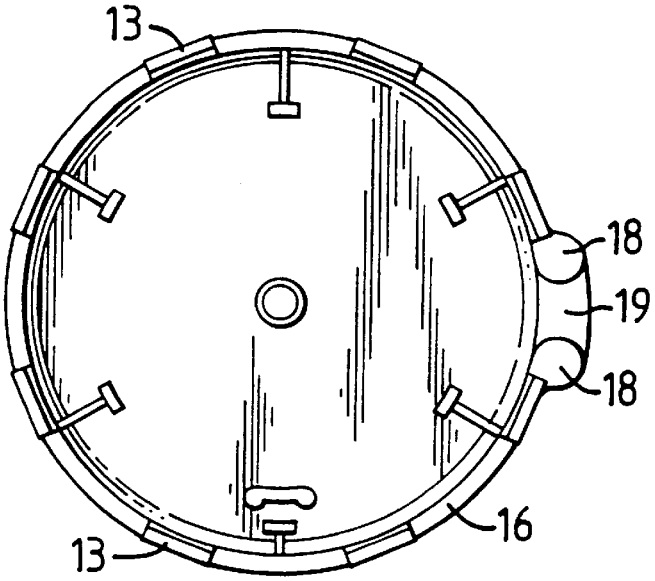
FIG. 3 is an end view of an end cap of the device of FIG. 1.

As the pinion moves axially of the drive shaft it slides along the pawl 100, the different contours of which engage with the ratchet 107 on the pinion. The nose end configuration of the pawl 100 is arranged so that the nose of the pawl is "self-caming" with the corresponding recess in the ratchet and the arrangement is such that with the pinion fully forward as shown in FIG. 2 only slight force is required to disengage the pawl from the pinion.

In operation, pulling on the winding rope will result in rotation of the winder drum 69 with corresponding rotation of the complete drive assembly including drive shaft 45. The pinion is lightly held against rotation by the action of spring 108 and is thus caused to advance to a position in which the teeth 105 engage with corresponding teeth on the starter ring of the engine to be started. When the pinion has advanced to the extremity of its travels, the profile of the pawl shown in section 12*c* will be engaged with a recess in ratchet 107 thereby locking the pinion against rotation with respect to the pinion housing and the casing 10 attached thereto. At the same time because the pinion is at the forward extremity of its travel, shaft 45 will also be locked against rotation. Pulling on the rope will result in winding of the spring 90 in the manner described above and will produce rotation of the cam. Continued strokes of the winding rope will produce progress tightening of the spring 90 until the cam 94 has rotated until cam lobe 97 engages under pawl 100 to lift the body of pawl 100 out of engagement with the corresponding recess in ratchet 107 of pinion 104.

Free from its constraint, the shaft 45 and pinion 104 carried thereby is free to rotate under the influence of the spring which then imparts direct rotational movement to the shaft which drives the pinion which in turn drives the ring gear on the flywheel of the engine to be started. When the engine fires, the backlash of the ring gear reduces and removes the frictional loading on the pinion 105 and the compression spring 108 drives the pinion out of engagement of the ring gear to the start position. The cam 94 will now have rotated so that the lobe 97 will have passed the point of contact with the pawl 100, the pawl 100 will now be engaged with the ratchet 107 and the body of the pawl will be in contact with the arm 98 which being flexible will serve to urge the cam out of engagement with the recess until winding has commenced to such an extent that the pinion has once again moved forward along the shaft 45 to engage the ring gear, by which time the cam lobe 94 will have advanced sufficiently that the arm will be out of engagement with the pawl and the pawl will be once more engage with a recess in ratchet 107.

With the exception of the spring, the components of this starter device can all be made of structural plastics materials. The result is that the resultant starter device is light in weight, requires no bearings and apart from the spring, is substantially corrosion proof.

The cam release arrangement of the device described above provides protection against over-winding of the spring. If the spring is over-wound then the smooth energy delivery profile of the spring is not achieved and in many cases the spring "collapses" to prevent the delivery of significant or sufficient amounts of energy. The cam release device of the present invention overcomes this problem. The performance output of the spring can be varied by changing the gear ratios between the various components of the epicyclic gear trains and the energy delivery device of the spring itself can be adjusted by a combination of length, spring thickness and spring width.

Starter devices in accordance with the present invention and generally as described above are suitable for starting all forms of ignition combustion engines.

I claim:

1. A mechanical starting device comprising a spiral power spring for storing energy, winding means for winding said spring to store energy therein, drive means for converting energy stored in said spring to provide a starting impulse for an engine, said spring and the winding means acting in conjunction with control means adapted to release energy stored in the spring to said drive means automatically when a predetermined amount of energy has been stored in the spring; and wherein said drive means includes a rotatory drive shaft drivably connected to said spiral power spring, and said control means comprises a latch to prevent rotation of the drive shaft during winding and release means for unlatching the drive shaft when a predetermined amount of energy has been stored in said spring.

2. A mechanical starting device comprising a housing, a spiral power spring for storing energy, winding means for winding said spring to store energy therein, drive means for converting energy stored in said spring to provide a starting impulse for an engine, said drive means including a rotary drive shaft drivably connected to said spring, and control means, said control means comprising a latch to prevent rotation of the drive shaft during winding and release means for automatically unlatching said drive shaft when a predetermined amount of energy has been stored in said spring.

3. A device as claimed in claim 2 wherein the components with the exception of the spiral power spring are formed of structural plastics materials.

4. A device as claimed in claim 2 wherein the latch comprises a pawl and associated ratchet active between the drive shaft and the housing.

5. A device as claimed in claim 4 wherein said pawl is located on a fixed part of the housing and the ratchet is associated with the drive shaft.

6. A device as claimed in claim 5 wherein said control means further comprises a cam arranged to rotate in response to the winding of said winding means, said pawl being arranged to coact with said cam such that rotation of the cam brings the cam into a tripping relationship with the pawl when a predeterminal amount of energy has been applied to the spring.

7. A device as claimed in claim 6 wherein said winding means includes a rotatory spring housing, and the cam is positioned to be driven by the spring housing.

8. A device as claimed in claim 7 wherein said control means comprises an epicyclic gear train mounted between said spring housing and said cam.

9. A device as claimed in claim 4 wherein said pawl is provided with a contoured nose at one end thereof, and said ratchet comprises a wheel having an outer surface, which outer surface defines a plurality of contoured ratchet recesses, each adapted to be engagable with said contoured nose on the pawl.

10. A device as claimed in claim 4 wherein said drive means includes a drive pinion which is engagable with a starter ring on an engine to enable the delivery of a starting impulse to the engine.

11. A device as claimed in claim 10 wherein said drive pinion is formed integrally with said ratchet.

12. A device as claimed in claim 11 wherein said drive pinion is mounted on said drive shaft, and is movable axially along said drive shaft into a forward position in which said drive pinion is engagable with a starter ring on an engine.

13. A device as claimed in claim 12 wherein said drive shaft is provided with multi-part teeth at a forward end thereof, and said drive pinion is provided with a central bore with multi-start threads or teeth cut internally thereof, said drive pinion being mounted on the forward end of said drive shaft, whereby rotation of the drive shaft relative to the drive pinion causes the drive pinion to advance along said drive shaft towards said forward position.

14. A device as claimed in claim 13 wherein said control means further comprises biasing means for biasing said pinion out of said forward position.

15. A device as claimed in claim 13 wherein said pawl extends longitudinally of said drive shaft such that said pawl remains in engagement with said ratchet as said drive pinion advances along the drive shaft.

16. A device as claimed in claim 7 wherein said spiral power spring comprises an inner end that is secured to said drive shaft, and an outer end rotated by said winding means.

17. A device as claimed in claim 16 wherein said inner end of said spiral power spring is secured to said drive shaft by an adhesive.

18. A device as claimed in claim 16 wherein said winding means further comprises a rope pull winder having a rotatory rope drum operatively connected to said rotatory spring housing such that rotation of the rope drum causes rotation of said spring housing.

19. A device as claimed in claim 18 wherein said spring housing is attached to the outer end of said spiral power spring.

20. A device as claimed in claim 18 wherein said winding means further comprises a winding ratchet assembly and an epicyclic gear train connected between said rotatory rope drum and said rotatory spring housing, which winding ratchet assembly comprises a plurality of concentric ratchets.

21. A device as claimed in claim 17 or claim 19 wherein the adhesive is an adhesive based on methyl methacrylate.

22. An ignition compression engine comprising a flywheel provided with a toothed starter ring and mechanical starting means for delivering a starting impulse to said flywheel in order to start the engine, said mechanical starting means comprising a spiral power spring for storing energy, winding means for winding said spring to store energy therein, drive means including a rotatory drive shaft drivably connected to said spring and a starter pinion mounted on said drive shaft and engagable with said starter ring on the flywheel, and control means comprising a latch to prevent rotation of the drive shaft during winding and release means for automatically unlatching said drive shaft when a predetermined amount of energy has been stored in the spring; whereby rotation of said drive shaft when the starter pinion is engaged with said toothed starter ring on the flywheel results in the delivery of a starting impulse to the flywheel.

23. An engine as claimed in claim 22 wherein said starter pinion engages said toothed starter ring before winding of the spring means commences.

* * * * *